US007500734B2

(12) United States Patent
Nakamura

(10) Patent No.: US 7,500,734 B2
(45) Date of Patent: Mar. 10, 2009

(54) INKJET RECORDING HEAD AND INKJET RECORDING DEVICE

(75) Inventor: Hirofumi Nakamura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 470 days.

(21) Appl. No.: 10/980,189

(22) Filed: Nov. 4, 2004

(65) Prior Publication Data

US 2005/0140742 A1 Jun. 30, 2005

(30) Foreign Application Priority Data

Dec. 24, 2003 (JP) ..... 2003-427740

(51) Int. Cl.
*B41J 2/045* (2006.01)
*B41J 29/38* (2006.01)

(52) U.S. Cl. ..... 347/68; 347/10; 347/11; 347/70

(58) Field of Classification Search ..... 347/68, 347/70, 71, 72, 6, 10–12; 73/861.18, 861.19, 73/861.22, 861.34
See application file for complete search history.

(56) References Cited

U.S. PATENT DOCUMENTS 5,510,819 A * 4/1996 Fujimoto et al. ..... 347/70
6,575,544 B2 * 6/2003 Iriguchi ..... 347/11
6,799,821 B1 10/2004 Okuda ..... 347/10

FOREIGN PATENT DOCUMENTS

| | | |
|---|---|---|
| CN | 1323260 | 11/2001 |
| EP | 608135 A2 * | 7/1994 |
| EP | 1123806 A1 * | 8/2001 |
| JP | A-6-218917 | 8/1994 |

OTHER PUBLICATIONS

Fluid Mechanics Glossary [online]. Efunda: Engineering Fundamentals [retrieved on Jan. 7, 2008]. Retrieved from the Internet: <URL> http://www.efunda.com/fluids/glossary.cfm?ref=Iam. Definition for rotational flow.*

* cited by examiner

*Primary Examiner*—Luu Matthew
*Assistant Examiner*—Lisa M Solomon
(74) *Attorney, Agent, or Firm*—Morgan, Lewis & Bockius LLP

(57) ABSTRACT

In a recording head which discharges ink, which is supplied from an ink flow path to pressure chambers, from nozzles by operation of actuators, one actuator is provided for each pressure chamber. The actuator is driven and controlled such that plural resonance modes of the actuator are simultaneously vibrated with phases thereof offset in time.

18 Claims, 11 Drawing Sheets

PRIOR
ART

PRIOR
ART

INKJET RECORDING HEAD AND INKJET RECORDING DEVICE

CROSS-REFERENCE TO RELATED APPLICATION

This application claims priority under 35 USC 119 from Japanese Patent Application No. 2003-427740, the disclosure of which is incorporated by reference herein.

BACKGROUND OF THE INVENTION

1. Field of the Invention

The present invention relates to an inkjet recording head and an inkjet recording device having, for each nozzle, a pressure chamber which discharges, from the nozzle, ink which has been supplied from an ink tank.

2. Description of the Related Art

An inkjet recording device has conventionally been known which discharges ink drops selectively from a plurality of nozzles which move reciprocally in a main scanning direction (called an "inkjet recording head" upon occasion), and prints characters or images or the like onto a recording medium such as a recording sheet or the like which is conveyed in along a subscanning direction.

Such an inkjet recording device uses a recording head which is a piezoelectric-type recording head, a bubble-type recording head, or the like. For example, in the case of a piezoelectric-type recording head, as shown in FIGS. 11A and 11B, a piezoelectric element (an actuator which converts electrical energy into mechanical energy) 104 is provided at a pressure chamber 102 which serves as an ink chamber to which ink 100 is supplied from an ink tank. The piezoelectric element 104 applies pressure to the ink 100 within by flexurally deforming in a concave form so as to reduce the volume of the pressure chamber 102, and discharges the ink 100 as ink drops 100A from a nozzle 106 which communicates with the pressure chamber 102.

In such a recording head, the ability to discharge highly-viscous inks in order to print at a high image quality has been demanded in recent years. Further, also in the fields of manufacturing precise wiring boards, image output device filters, and the like, the ability to discharge highly-viscous media by using an inkjet recording device (an inkjet recording head) is desired.

However, in the above-described piezoelectric-type and the bubble-type inkjet recording heads, after an ink drop is discharged from a nozzle, the refilling of ink from the ink tank into the pressure chamber (the ink flow path) which communicates with that nozzle is carried out by surface tension, which is a mechanism which the ink itself has. Therefore, there is the problem that a long time is required for this refilling. Accordingly, when the ink (the medium) is highly viscous, a problem arises in that the ink refilling time is even longer.

In order to overcome this problem, there is an inkjet recording head (see, for example, Japanese Patent Application Laid-Open (JP-A) No. 6-218917) in which a plurality of piezoelectric elements are disposed rectilinearly (in a row) at predetermined intervals at a pressure chamber (an ink flow path) which communicates with a nozzle. By offsetting the phases of the alternating current voltages applied to the respective piezoelectric elements, a rectilinear traveling wave is generated within the pressure chamber, and discharges the ink within the pressure chamber out from the nozzle.

In accordance with such a structure, by driving the piezoelectric elements, the upstream side of the interior of the pressure chamber becomes negative pressure at the same time that the ink within the pressure chamber flows out in the direction of the nozzle. Therefore, even if the ink (medium) is highly viscous, it can be suitably pulled into (flow into) the pressure chamber from the interior of the ink tank. Accordingly, there is no need to wait for the ink to be refilled to the interior of the pressure chamber, and the next ink can be discharged right away.

However, in this structure, the plurality of piezoelectric elements must be provided in a row within the single pressure chamber (ink flow path). Therefore, the surface area of placement thereof is large, and there is the problem that a recording head in which nozzles are disposed at a high density cannot be realized. Further, because a plurality of the pressure chambers (ink flow paths) are provided for each nozzle, a large number of piezoelectric elements is required for a single recording head, and as a result, there is the problem that the manufacturing cost is high.

SUMMARY OF THE INVENTION

In view of such problems, the present invention provides an inkjet recording head and an inkjet recording device in which the time for refilling ink into a pressure chamber which communicates with a nozzle can be shortened. Further, the present invention provides an inkjet recording head in which nozzles can be disposed at a high density. Moreover, the present invention provides an inkjet recording head and inkjet recording device which aim for a reduction in manufacturing cost.

In accordance with one aspect of the present invention, there is provided an inkjet recording head having: an ink flow path; and a plurality of ejectors which are connected to the ink flow path, each ejector including a pressure chamber, a nozzle, and a single actuator which can deform an internal space of the pressure chamber in order to discharge ink, wherein the actuator is driven and controlled so as to simultaneously vibrate a plurality of resonance modes with phases thereof offset in time.

In accordance with another aspect of the present invention, there is provided an inkjet recording device jetting ink drops onto a medium, the device having: (A) a plurality of inkjet units, each inkjet unit having a head and an ink tank which are structured integrally, the head including: (i) an ink flow path; and (ii) a plurality of ejectors which are connected to the ink flow path, each ejector including a pressure chamber, a nozzle, and a single actuator which can deform an internal space of the pressure chamber in order to discharge ink, (iii) wherein the actuator is driven and controlled so as to simultaneously vibrate a plurality of resonance modes with phases thereof offset in time; (B) a holding section integrally accommodating the inkjet units; and (C) a mechanism for moving and driving at least one of the medium and the holding section at a time of jetting ink drops.

The above and other features and advantages of the present invention will become apparent to those skilled in the art from the description of the preferred embodiments of the present invention which are shown in the appended drawings, and from the appended claims.

BRIEF DESCRIPTION OF THE DRAWINGS

Preferred embodiments of the invention will be described in detailed based on the following figures, wherein.

DETAILED DESCRIPTION OF THE INVENTION

Figure 1:
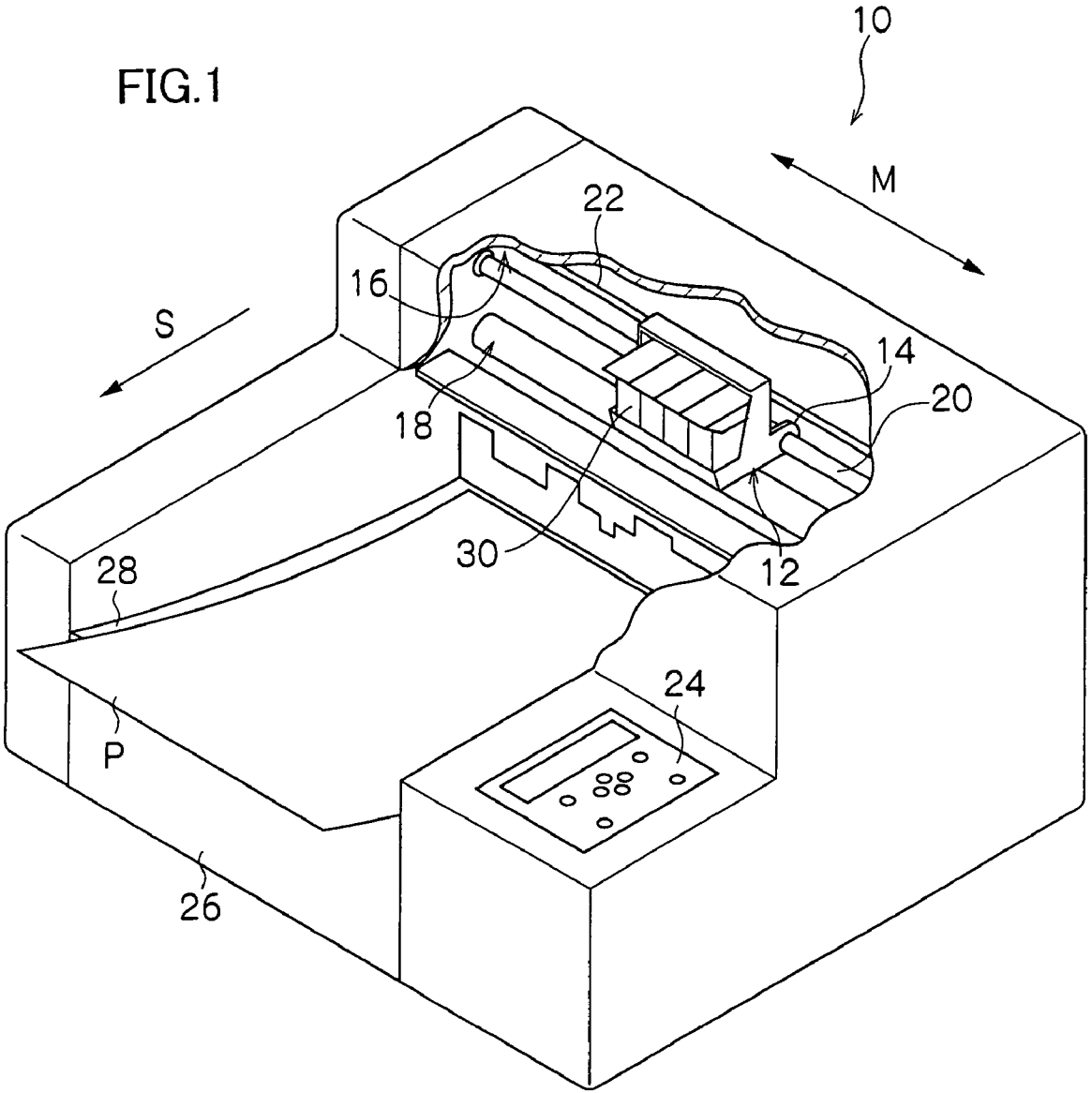
FIG. 1 is a schematic perspective view showing an inkjet recording device.

Hereinafter, embodiments relating to the present invention will be described in detail with reference to the drawings.

The conveying direction of a recording sheet P within an inkjet recording device is denoted by arrow S as the subscanning direction. The direction orthogonal to the conveying direction S is denoted by arrow M as the main scanning direction, and the flow of ink is denoted by arrow F.

In the drawings, the arrows UP, LO, FR, RE, LE, RI respectively denote the upward direction, downward direction, frontward direction, rearward direction, left direction, and right direction.

As shown in FIG. 1, an inkjet recording device 10 has a carriage 12 on which is mounted respective inkjet recording units 30 (inkjet recording heads 32) of black, yellow, magenta, and cyan. A pair of brackets 14 project from the upstream side of the carriage 12 in the conveying direction of the recording sheet P. Circular open holes 14A (see FIG. 2) are provided in the brackets 14. A shaft 20, which extends in the main scanning direction, is inserted through the open holes 14A.

Driving pulleys (not illustrated) and driven pulleys (not illustrated) which structure a main scanning mechanism 16 are provided at the both end sides in the main scanning direction. A timing belt 22 is trained around the driving pulleys and the driven pulleys, and travels in the main scanning direction. One portion of the timing belt 22 is fixed to the carriage 12. Accordingly, the carriage 12 is supported and structured so as to be able to move reciprocally in the main scanning direction.

A sheet feed tray 26, which is for accommodating a stack of the recording sheets P before image printing, is provided at the inkjet recording device 10. A sheet discharge tray 28, into which the recording sheets P after image printing are discharged, is provided above the sheet feed tray 26. Further, there is provided a subscanning mechanism 18 which is formed from discharge rollers and conveying rollers which convey the recording sheets P, which have been fed one-by-one from the sheet feed tray 26, at a predetermined pitch in the subscanning direction.

In addition, a control panel 24 for carrying out various types of setting at the time of printing, a maintenance station (not illustrated), and the like are provided at the inkjet recording device 10. The maintenance station is structured so as to include capping members, a suction pump, dummy jetting receptacles, a cleaning mechanism, and the like, and carries out maintenance operations such as suction and recovery, dummy jetting, cleaning, and the like.

Figure 2:
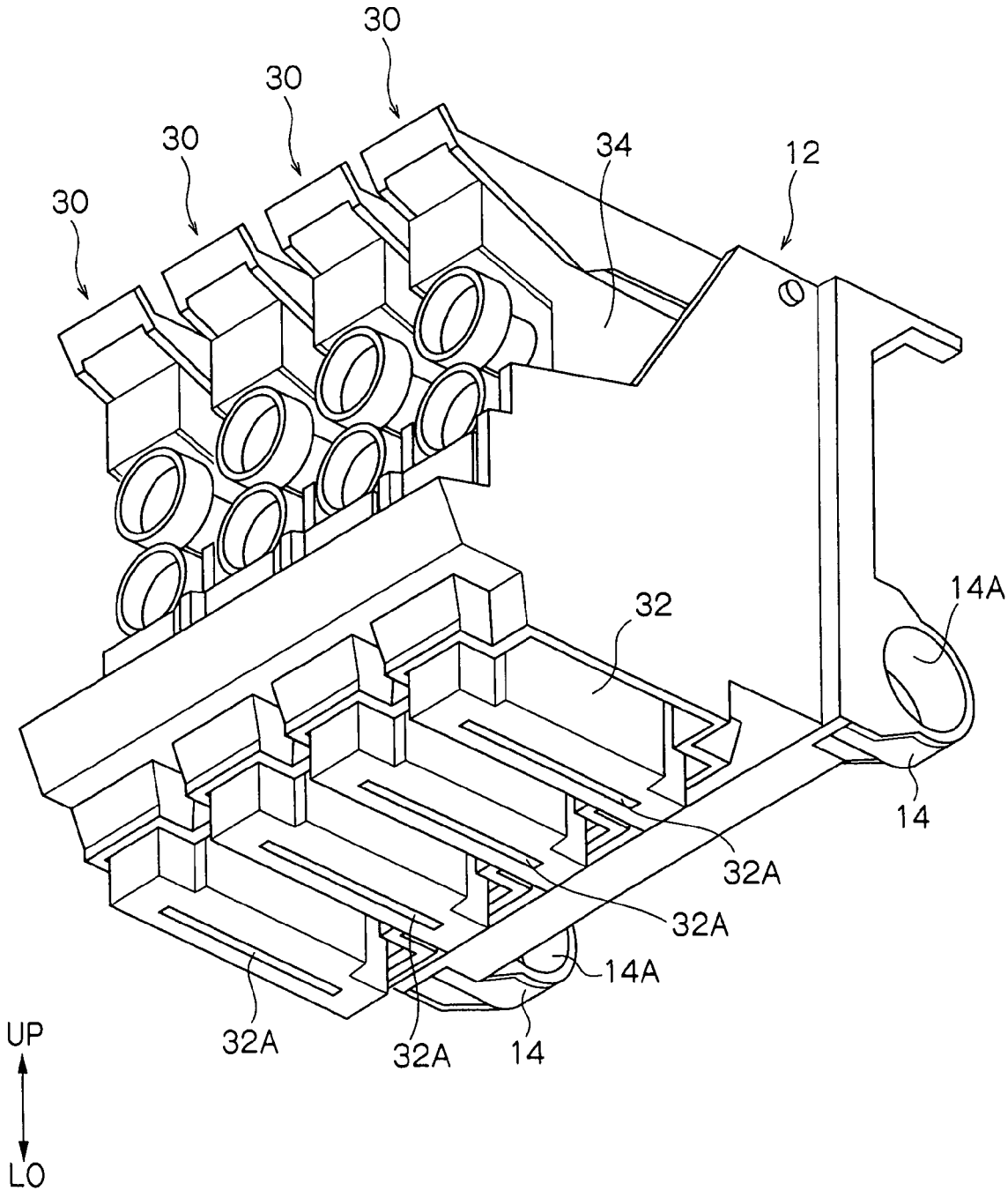
FIG. 2 is a schematic perspective view showing inkjet recording units installed at a carriage.

As shown in FIG. 2, the inkjet recording unit 30 of each color is formed such that an inkjet recording head (hereinafter, "recording head") 32 and an ink tank 34 supplying ink thereto, are structured integrally.

A plurality of nozzles 42 (see FIG. 3), which are formed at an ink discharge surface 32A at the center of the bottom surface of the recording head 32, are mounted on the carriage 12 so as to face the recording sheet P.

While the recording heads 32 are moved in the main scanning direction by the main scanning mechanism 16, ink drops are selectively discharged onto the recording sheet P from the nozzles 42. A portion of an image based on image data is thereby recorded onto a predetermined band region.

When one movement in the main scanning direction has been completed, the recording sheet P is conveyed a predetermined pitch in the subscanning direction by the subscanning mechanism 18. While the recording heads 32 (the inkjet recording units 30) again move in the main scanning direction (the direction opposite to that in the above description), a portion of the image based on the image data is recorded onto the next band region. By repeating this series of operations plural times, the entire image based on the image data is recorded in full color on the recording sheet P.

Next, the recording head 32 will be described in detail.

Figure 3:
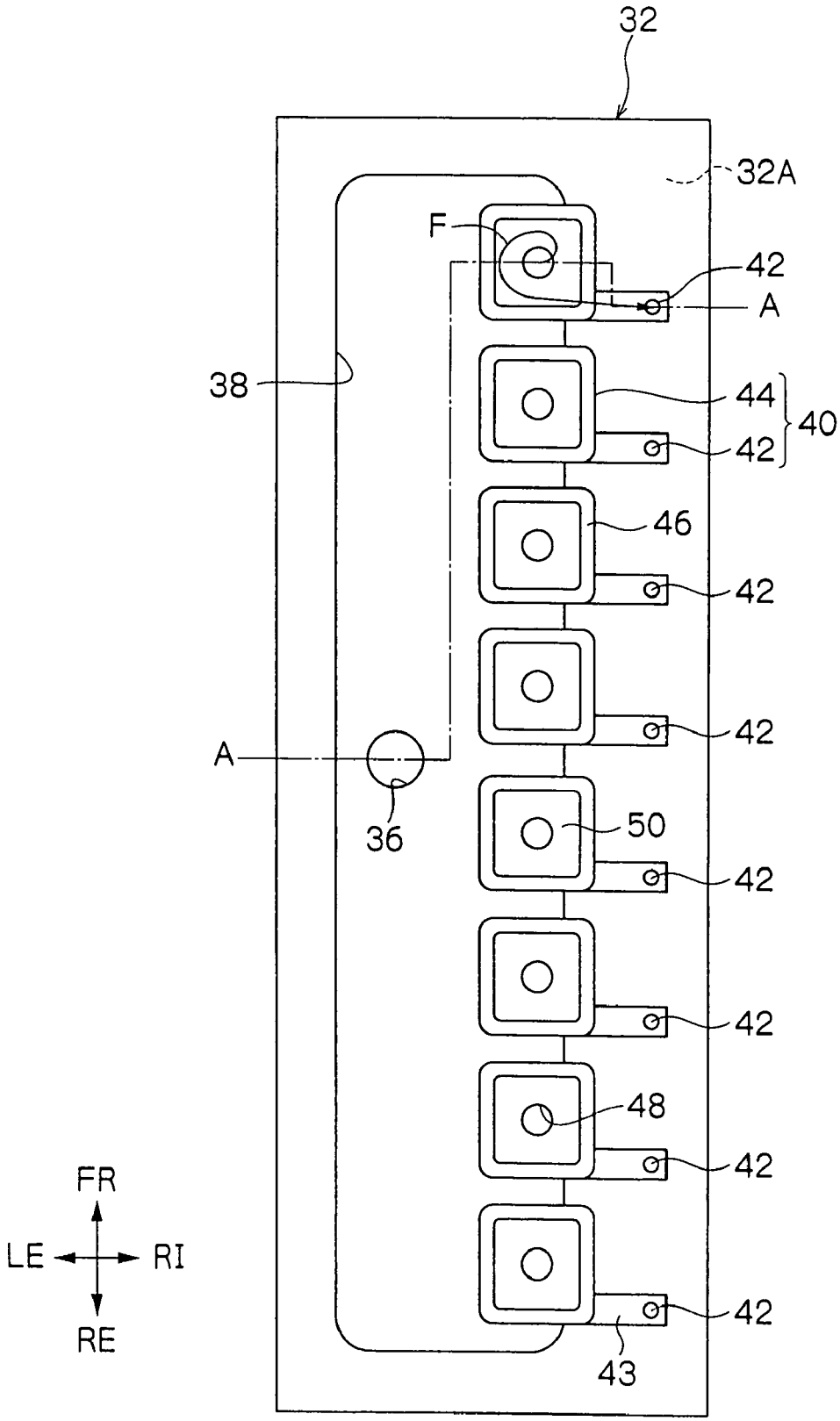
FIG. 3 is a schematic plan view showing the structure of an inkjet recording head.
Figure 4A:
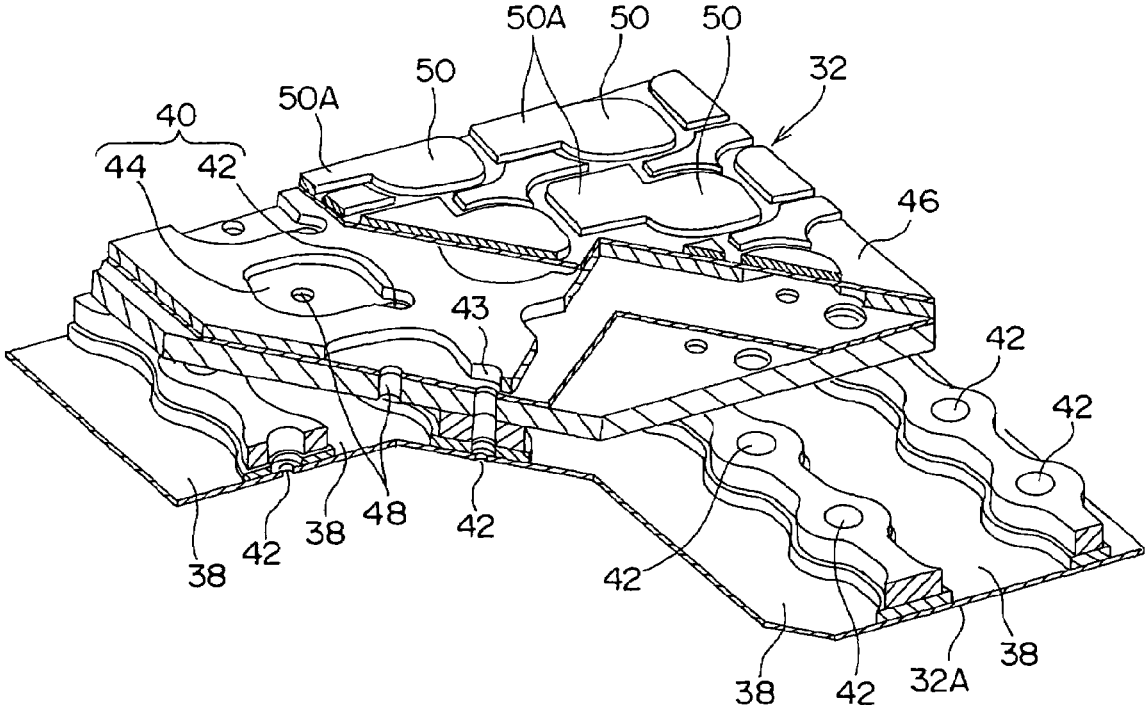
FIGS. 4A and 4B are schematic perspective sectional views showing the structure of the inkjet recording head.
Figure 4B:
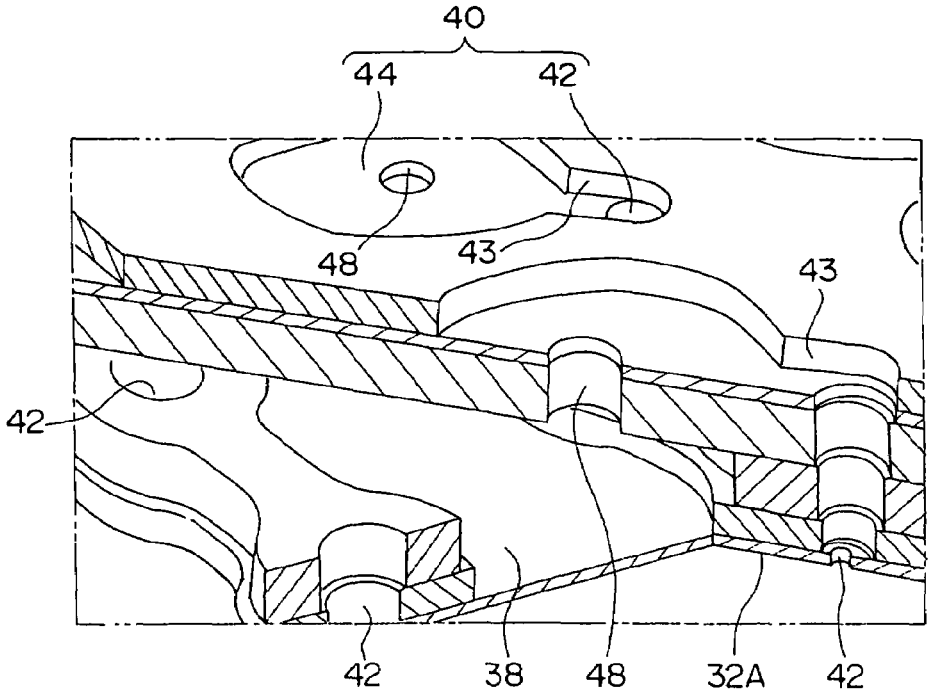

Referring to FIGS. 3, 4A and 4B, ink injection openings 36 which communicate with the ink tank 34 are provided at the recording head 32. The ink which is injected from the ink injection openings 36 is accumulated in long, thin pools 38 which are ink flow paths common to respective pressure chambers 44 which will be described later. In FIG. 3, only one pool 38 is illustrated, but actually, as shown in FIGS. 4A and 4B, a plurality of the pools 38 are lined up in parallel so as to be separated by predetermined intervals in the direction of the short sides thereof.

A large number of ejectors 40 are disposed so as to be separated by predetermined intervals in the longitudinal direction of the pools 38. Each ejector 40 is formed from the nozzle 42 which discharges ink drops, and the pressure chamber 44 which communicates with the nozzle 42 and increases and decreases the pressure of the ink in order to discharge the ink drops from the nozzle 42. Namely, the respective ejectors 40 are disposed in a row in the longitudinal direction of the pools 38 such that the pressure chambers 44 overlap with the pools 38 and such that the nozzles 42 thereof are arranged in a staggered manner with respect to the nozzles 42 of the ejectors 40 of the pools 38 adjacent thereto.

Accordingly, the respective nozzles 42 are disposed overall at a high density in the form of a matrix. In this way, by one movement of the carriage 12 in the main scanning direction, an image can be formed over a broad band region, and the scanning time thereof can be short. Namely, high-speed printing, in which an image is formed over the entire surface of the recording sheet P with a small number of movements of the carriage 12 and in a short time, can be realized.

Figure 5A:
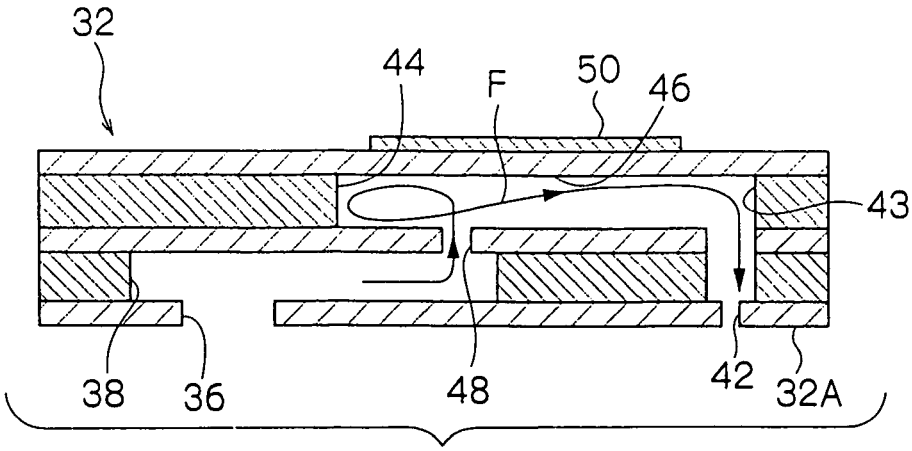
FIGS. 5A through 5C are sectional views taken along line A-A of FIG. 3.
Figure 5B:
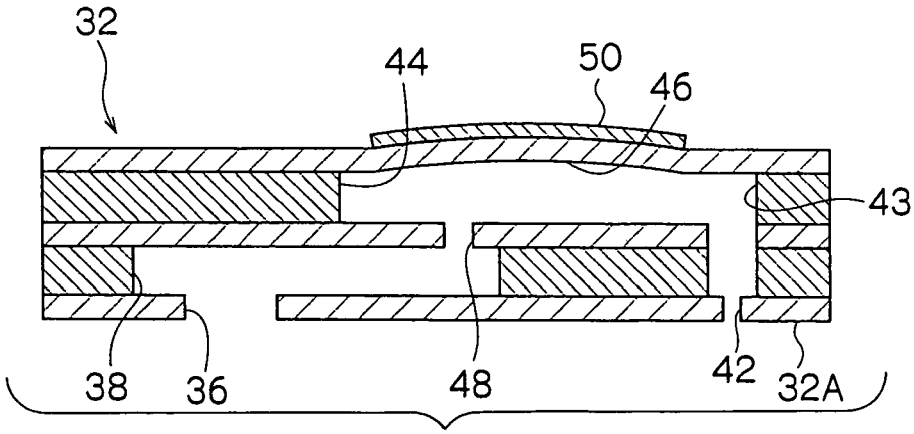
Figure 5C:
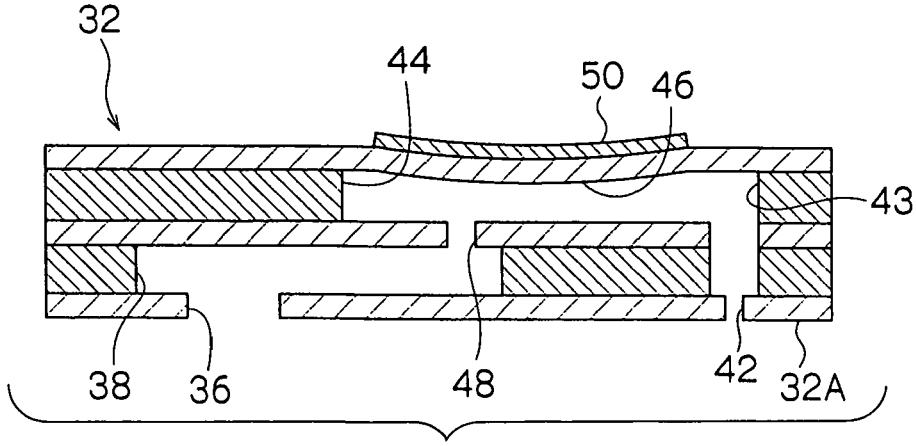
Figure 5C:
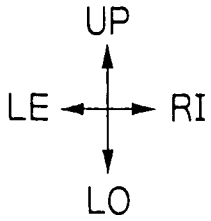

The pressure chamber 44 is formed to be substantially quadrangular in plan view (preferably, substantially circular in plan view). A vibrating plate 46, which is elastic at least in the vertical direction, is provided above the pressure chamber 44 (see FIG. 5A). A piezoelectric element (actuator) 50 which out-of-plane vibrates (flexurally deforms) the vibrating plate 46, i.e., flexurally deforms the vibrating plate 46 in the vertical direction as shown in FIGS. 5B and 5C, is adhered to the top surface of the vibrating plate 46.

Figure 6A:
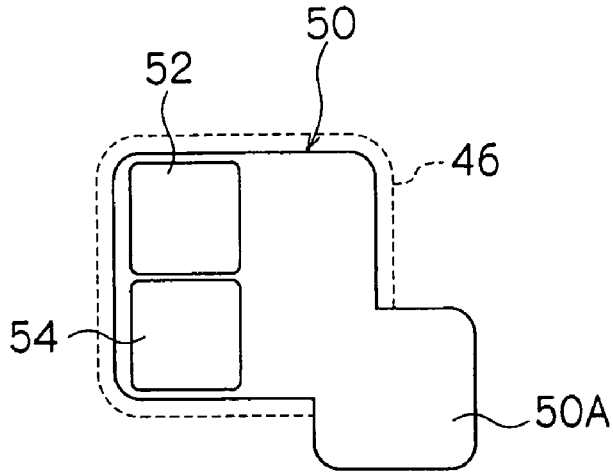
FIGS. 6A through 6C are plan views of a piezoelectric element.
Figure 6B:
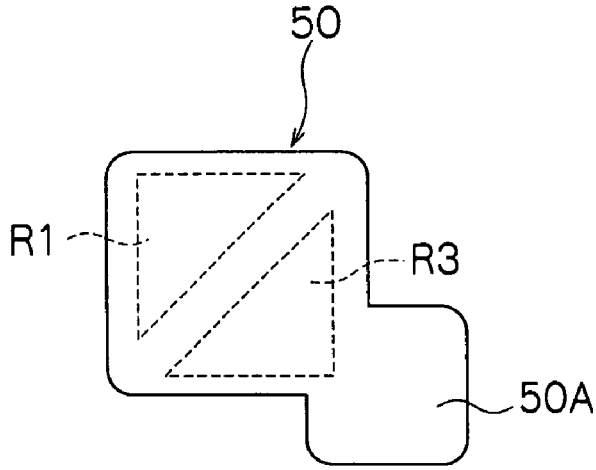
Figure 6C:
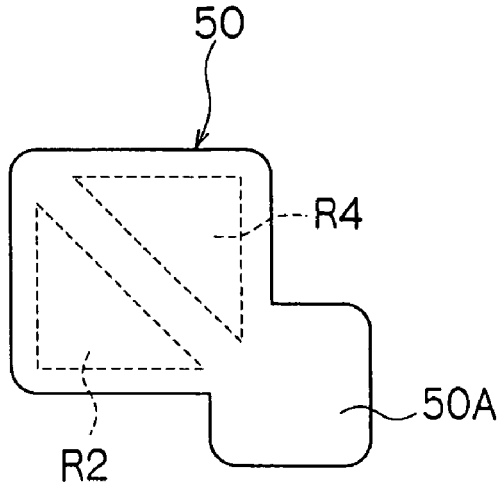
Figure 6C:
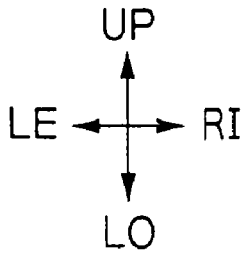

As shown in FIGS. 4A and 4B and in FIGS. 6A through 6C (but not in FIG. 3), the piezoelectric element 50 has an electrode pad portion (or wire connection portion) 50A which exists on the wall of the pressure chamber 44. One of the piezoelectric elements 50 is provided for each of the pressure chambers 44, and generates a rotating traveling wave, e.g., a counterclockwise rotational flow as shown by arrow F in FIG. 3, in the ink filled within the pressure chamber 44.

An ink supply opening (ink flow-in opening) 48, which communicates with the pool 38 (the ink flow path), is provided at the center of the surface of the pressure chamber 44 which surface opposes the vibrating plate 46. A communicating path (ink flow-out opening) 43, which communicates with the nozzle 42, is provided at the rear right corner portion of the pressure chamber 44.

Because, generally, the central portion of a rotational flow is negative pressure, the ink supply opening 48 is provided at the center of the pressure chamber 44. In FIG. 3, the outermost peripheral side of the rotational flow (shown by arrow F) which rotates counterclockwise is the largest positive pressure. Therefore, the communicating path 43 which communicates with the nozzle 42 is provided at a corner portion of the pressure chamber 44, e.g., the rear right corner portion. Owing to such a structure, the ink suitably flows into the pressure chamber 44 and is discharged from the pressure chamber 44 (the nozzle 42).

As shown in FIG. 6A, at the top surface of the pressure chamber 44, i.e., at the piezoelectric element 50 which out-of-plane vibrates (flexurally deforms) the vibrating plate 46, individual electrodes 52, 54, which are one polarity, are provided so as to be lined up at the upper side and the lower side of the left half side of the piezoelectric element 50. The individual electrodes 52, 54 are conductively connected by fine wires (not illustrated) to the electrode pad portion 50A, and are connected by solder joints from the electrode pad portion 50A to a driving circuit (not illustrated). The vibrating plate 46 is a common electrode of the other polarity.

With such a structure, the secondary resonance mode is out-of-plane flexural deformation in which the phases of region R1 and region R3 are inverted 180° with respect to one another, as shown in FIG. 6B. The tertiary resonance mode is out-of-plane flexural deformation in which the phases of region R2 and region R4 are inverted 180° with respect to one another, as shown in FIG. 6C. Note that the resonance frequencies of these resonance modes are substantially equivalent. Accordingly, a plurality of resonance modes can be vibrated simultaneously even by a voltage waveform having a single frequency.

Namely, alternating current voltages of sine waveforms (electric signals) which substantially coincide with the resonance frequencies corresponding to the resonance modes, are applied to the individual electrodes 52, 54 of the piezoelectric element 50 in a state in which the phases are offset by 90° in time. When this alternating current voltage is applied between the individual electrode 52 and the vibrating plate 46 (the common electrode), the secondary resonance mode is excited. Therefore, as shown in FIG. 6B, vibration arises in a state in which the phases are inverted by 180° at the region R1, which includes the individual electrode 52, and the region R3.

Figure 10:
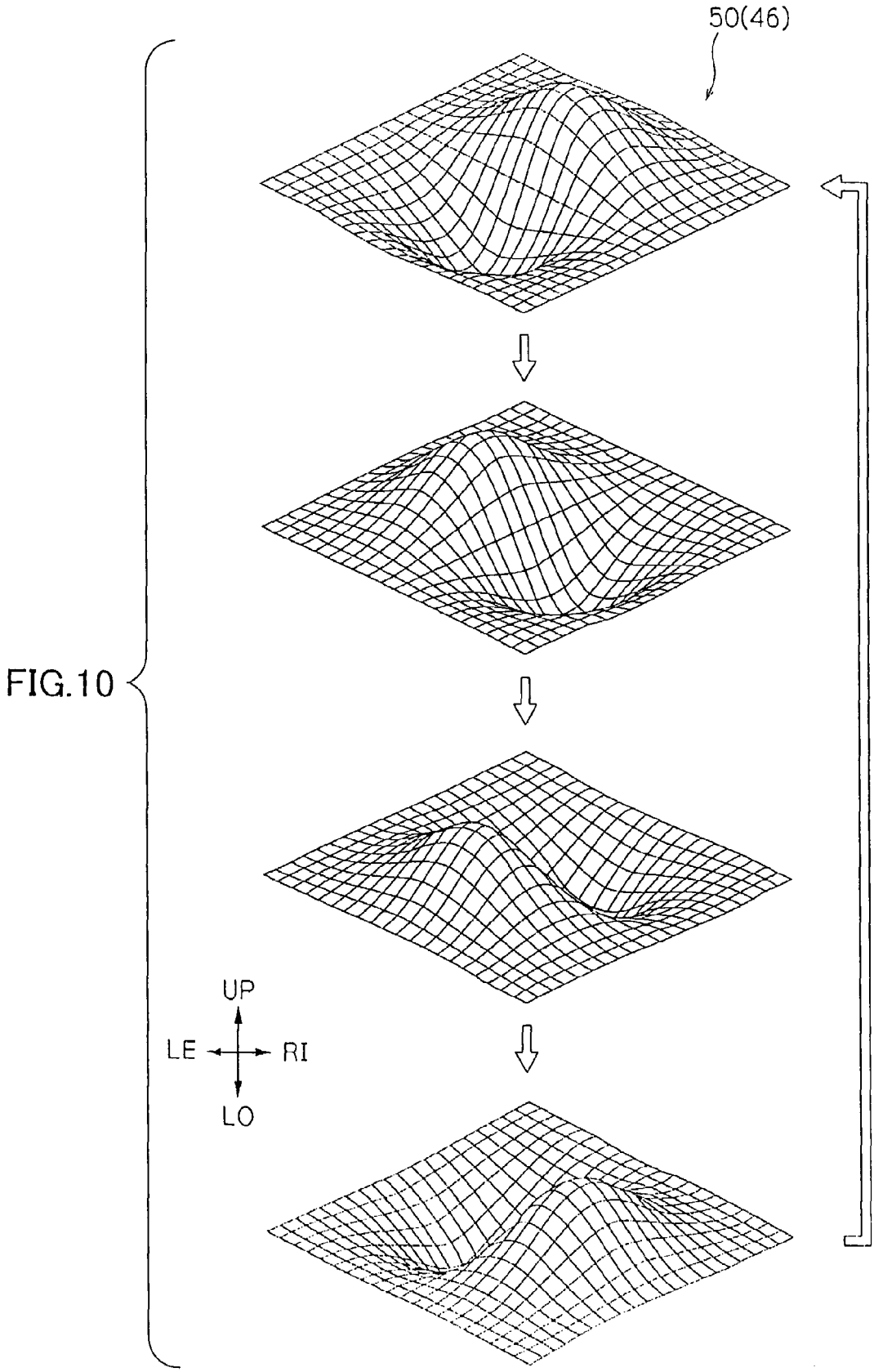
FIG. 10 is an explanatory drawing showing a state in which the piezoelectric element (vibrating plate) is excited and generates a rotating traveling wave.
Figure 11A:
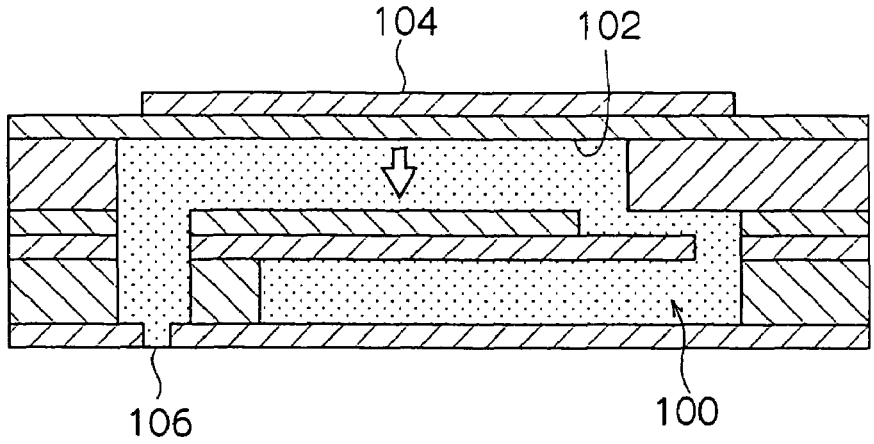
FIGS. 11A and 11B are schematic sectional views showing the structure of a conventional inkjet recording head.
Figure 11B:
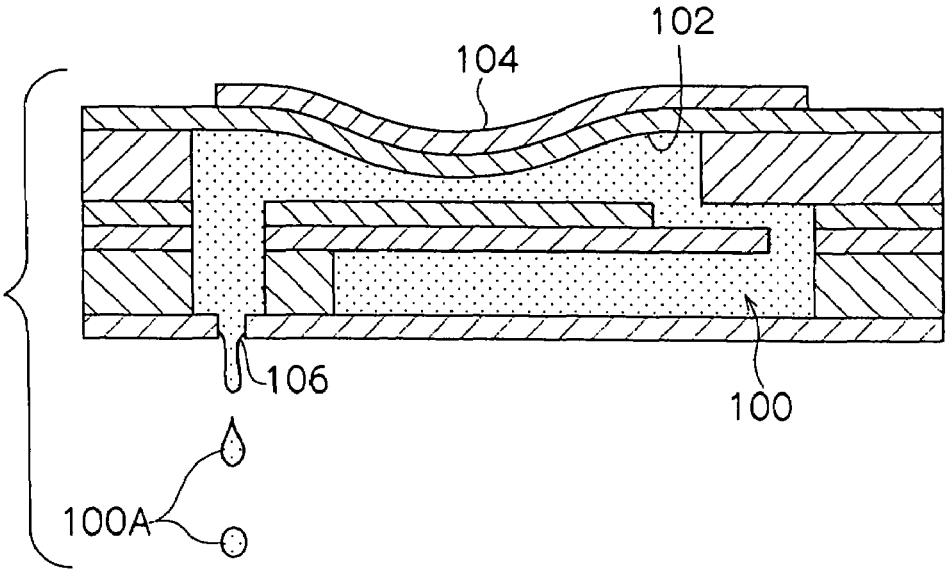

On the other hand, when the above-described alternating current voltage is applied between the individual electrode 54 and the vibrating plate 46 (the common electrode), the tertiary resonance mode is excited. Therefore, as shown in FIG. 6C, vibration arises in a state in which the phases are inverted by 180° at the region R2, which includes the individual electrode 54, and the region R4. Because the phases of these two alternating current voltages are offset 90° in time, a counterclockwise rotating traveling wave (flexural deformation) such as shown in FIG. 10 for example is generated, and as a result, a counterclockwise rotational flow is generated in the ink within the pressure chamber 44.

Figure 7A:
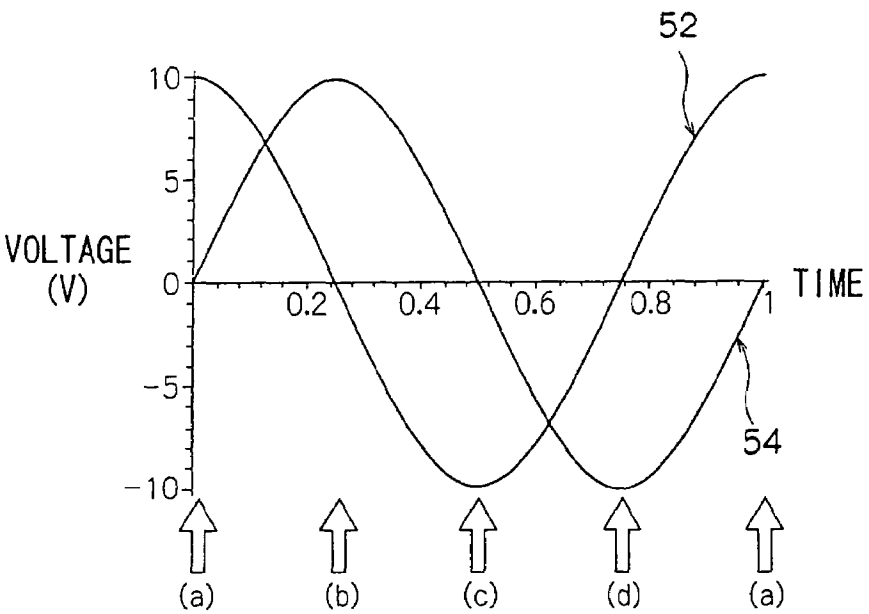
FIGS. 7A and 7B are explanatory drawings showing the waveforms of the alternating current voltages applied to the piezoelectric element of FIGS. 6A through 6C, and the deformation regions thereof.

Here, the process by which the rotating traveling wave is generated in the pressure chamber 44 by the vibration of the piezoelectric element 50, i.e., the process by which the pressure chamber 44 is compressively deformed, for example, in the illustrated counterclockwise direction by the vibration of the piezoelectric element 50, will be described even more concretely with reference to FIGS. 7A and 7B. Note that, in FIG. 7B, only the flexural deformation of the vibrating plate 46 is illustrated and the piezoelectric element 50 is not shown. However, in FIG. 7B, the bottom right is the direction of the electrode pad portion 50A.

Generally, when a voltage of a negative value (a backward voltage) is applied to the piezoelectric element 50, the piezoelectric element 50 attempts to extend, and the vibrating plate 46 therefore deforms convexly (see FIG. 5B). When a voltage of a positive value (a forward voltage) is applied, the piezoelectric element 50 attempts to contract, and the vibrating plate 46 therefore deforms concavely (see FIG. 5C). Convex and concave deformation are generated at the regions R1 through R4 by utilizing this characteristic.

Here, alternating current voltages of sine waveforms (electric signals), which substantially coincide with the resonance frequencies corresponding to the resonance modes of the vibrating plate 46, are applied, with the phases thereof shifted by 90° in time, to between the individual electrode 52 and the vibrating plate 46, and to between the individual electrode 54 and the vibrating plate 46, respectively. Note that, in FIG. 7A, reference numerals 52, 54 are applied to the waveforms of the alternating current voltages corresponding to the individual electrodes 52, 54 to which these voltages are applied, so as to distinguish the waveforms. Further, in FIG. 7B, the "+" sign shows convex deformation in the direction orthogonal to the surface of the drawing of FIG. 7B, and the "−" sign shows concave deformation in the direction orthogonal to the surface of the drawing of FIG. 7B.

Figure 7B:
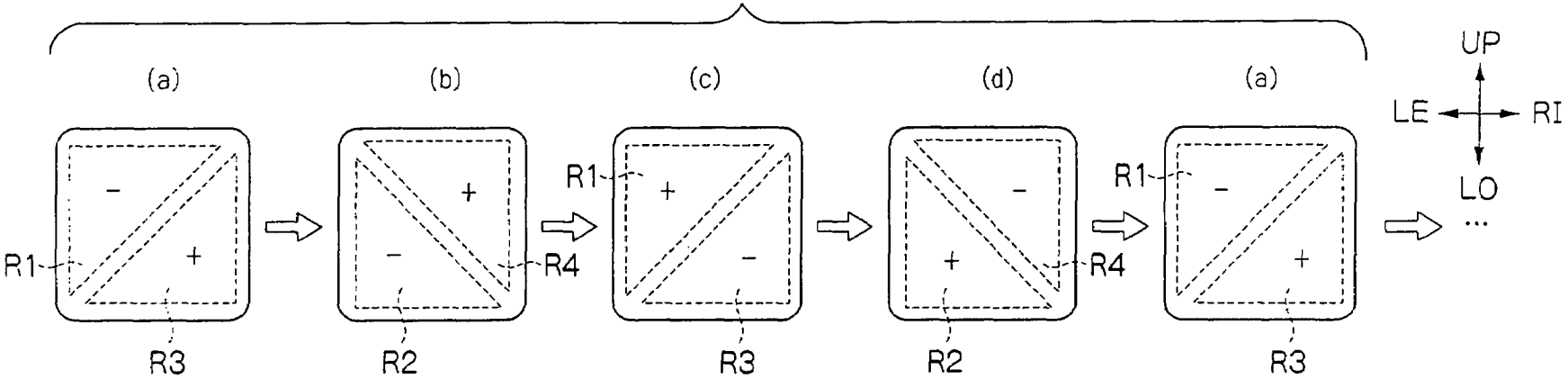

Reference is made here to {(a)→(b)→(c)→(d)→(a)} in FIG. 7B. First, in (a), a voltage of +10V is applied to only the individual electrode 52 at the upper side of the piezoelectric element 50, and the individual electrode 54 at the lower side is in a state in which voltage is not applied thereto. At this time, only the upper left side region R1 demarcated by the diagonal line directed upwardly toward the right of the vibrating plate 46, concavely deforms. Due to the secondary resonance mode which is excited simultaneously, the region R3 at the opposite lower right side convexly deforms naturally.

Next, in (b), a voltage of +10V is applied to only the individual electrode 54, without any voltage being applied to the individual electrode 52. Thus, only the lower left side region R2 demarcated by the diagonal line directed downwardly toward the right of the vibrating plate 46, concavely deforms. Due to the tertiary resonance mode which is excited simultaneously, the region R4 at the opposite upper right side convexly deforms naturally.

Then, in (c), a voltage of −10V is applied to only the individual electrode 52, without any voltage being applied to the individual electrode 54. Thus, only the upper left side region R1 demarcated by the diagonal line directed upwardly toward the right of the vibrating plate 46, convexly deforms. Due to the secondary resonance mode which is excited simultaneously, the region R3 at the opposite lower right side concavely deforms naturally.

Next, in (d), a voltage of −10V is applied to only the individual electrode 54, without any voltage being applied to the individual electrode 52. Thus, only the lower left side region R2 demarcated by the diagonal line directed upwardly toward the right of the vibrating plate 46, convexly deforms. Due to the tertiary resonance mode which is excited simultaneously, the region R4 at the opposite upper right side concavely deforms naturally.

Then, due to a state arising in which a voltage of +10V is applied to only the individual electrode 52 without any voltage being applied to the individual electrode 54, the state returns to the initial state shown in (a). Due to such concave and convex deformation continuously occurring repeatedly, a rotating traveling wave is generated within the pressure chamber 44.

Namely, due to a plurality of resonance modes, whose phases are offset 90° in time, being excited simultaneously at the vibrating plate 46, counterclockwise flexural deformation (convex and concave deformation) arises continuously at the vibrating plate 46 (see FIG. 10). As a result, compressive deformation of the pressure chamber 44 continuously arises in the counterclockwise direction. A counterclockwise rotational flow thereby arises in the ink within the pressure chamber 44.

Note that, it is also possible to generate a clockwise rotating traveling wave by making the phase offsets of the two voltage waveforms be opposite. Further, in the embodiment shown in FIGS. 7A and 7B, the time required from the (a) state to the original (a) state, i.e., the period of the alternating current voltage (=the inverse of the resonance frequency of the resonance mode), is normalized and expressed as 1. Accordingly, the period thereof can be appropriately changed by setting the resonance frequency. Further, the value of the applied voltage being ±10V is an example, and the voltage which is applied is not limited to this value.

As described above, alternating current voltages of sine waveforms (electric signals) which substantially coincide with the resonance frequencies corresponding to the resonance modes of the vibrating plate 46 are applied, with the phases thereof being offset by 90° in time, to between the individual electrode 52 and the vibrating plate 46, and to between the individual electrode 54 and the vibrating plate 46, respectively. In this way, at the vibrating plate 46, a plurality of resonance modes, which are orthogonal to one another spatially and whose phases are offset by 90° in time, can be excited simultaneously, and a rotating traveling wave which is counterclockwise or clockwise can thereby be generated.

Accordingly, as shown in FIG. 6A, it suffices to provide the individual electrodes 52, 54 only at the left half side of the piezoelectric element 50, and for this reason as well, the manufacturing cost can be reduced. Moreover, a structure is utilized in which a counterclockwise (or clockwise) rotational flow is generated in the ink within the pressure chamber 44, and the ink is discharged from the nozzle 42. Thus, it suffices to provide one piezoelectric element 50 at each pressure chamber 44, and even a highly viscous ink can be suitably discharged from the nozzle 42 due to this single piezoelectric element 50.

Figure 8A:
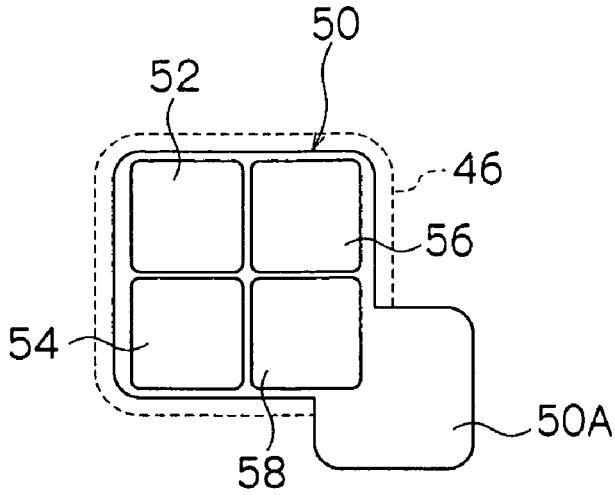
FIGS. 8A through 8C are plan views showing a piezoelectric element of another embodiment.

The individual electrodes 52, 54 are not limited to two electrodes provided at the upper side and the lower side (in the drawings) of the left half side of the piezoelectric element 50, and the two electrodes may be provided at the upper side and the lower side of the right half side. Or, two electrodes may be provided at the upper side and the lower side of each of the left half side and the right half side. Namely, as shown in FIG. 8A, it is possible to use the piezoelectric element 50 having a total of four individual electrodes 52, 54, 56, 58 in which the individual electrode 52 is provided at the upper left side of the piezoelectric element 50, the individual electrode 54 is provided at the lower left side, the individual electrode 56 is provided at the upper right side, and the individual electrode 58 is provided at the lower right side.

Figure 8B:
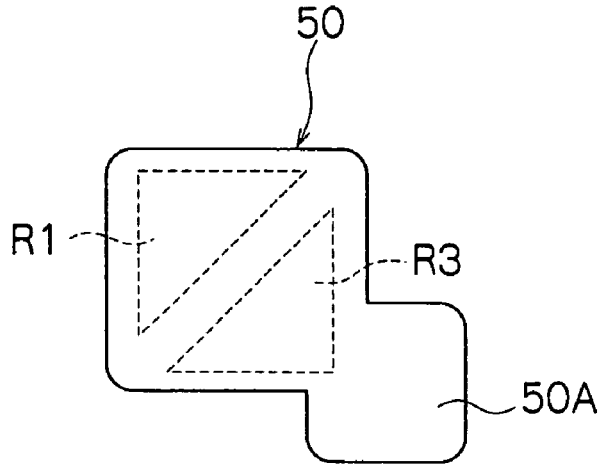
Figure 8C:
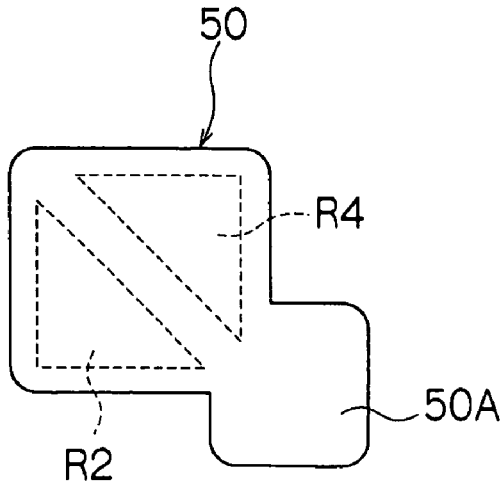
Figure 8C:
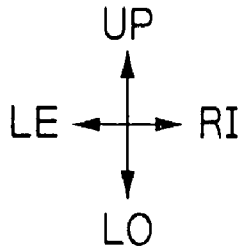

Also when alternating current voltages, whose phases are offset by 90° in time from one another, are applied to the individual electrodes 52, 54, 56, 58 of the piezoelectric element 50 having this structure, in the same way as described above, flexural deformation (convex and concave deformation) in mutually opposite directions can be generated at the predetermined regions R1, R3 shown in FIG. 8B, and at the predetermined regions R2, R4 shown in FIG. 8C, respectively.

Figure 9A:
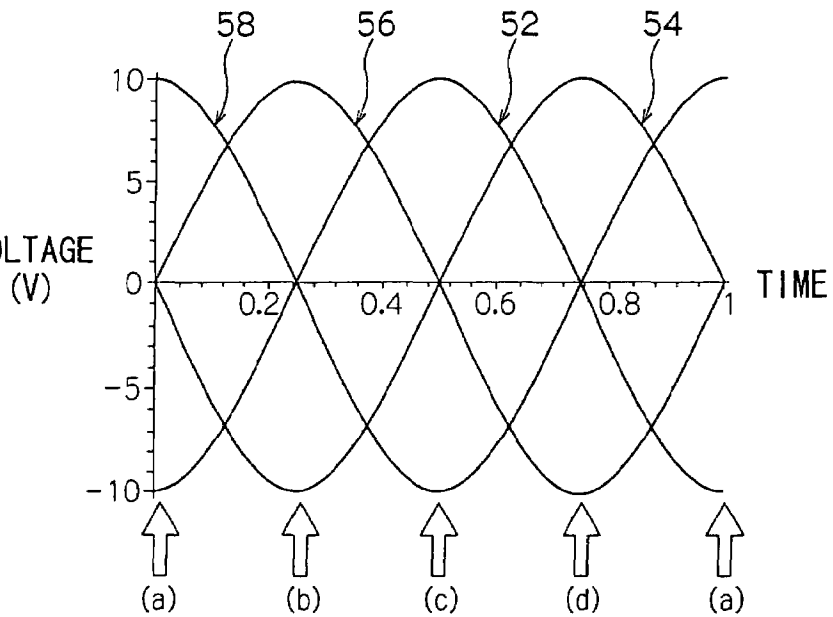
FIGS. 9A and 9B are explanatory drawings showing the waveforms of the alternating current voltages applied to the piezoelectric element of FIGS. 8A through 8C, and the deformation regions thereof.
Figure 9B:
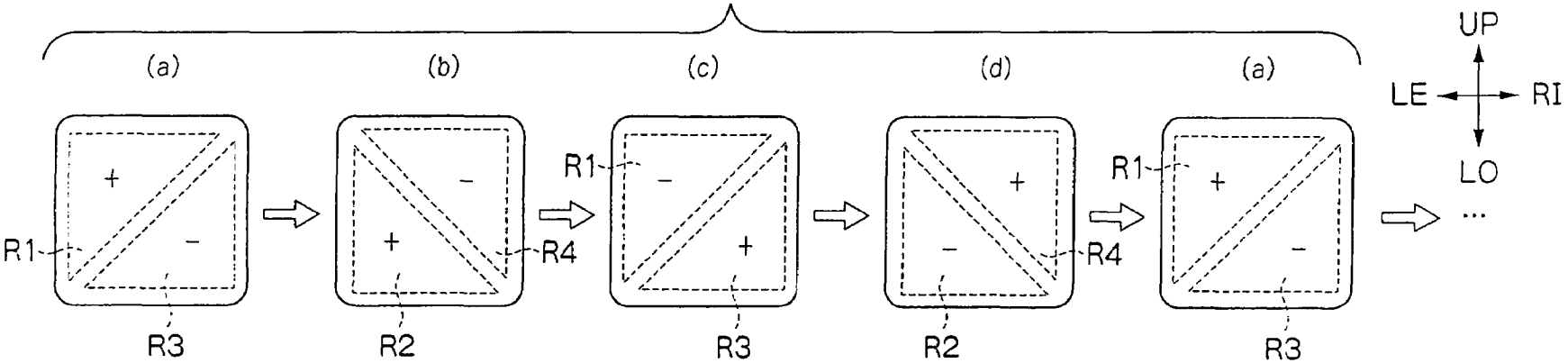

Reference is made here to {(a)→(b)→(c)→(d)→(a)} of FIG. 9B. First, in (a), a voltage of −10V is applied to the individual electrode 52 at the upper left side of the piezoelectric element 50, a voltage of +10V is applied to the individual electrode 58 at the lower right side, and voltage is not applied to the remaining individual electrodes 54, 56. Thus, at the vibrating plate 46, the upper left side region R1 demarcated by the diagonal line directed upwardly toward the right convexly deforms, and the region R3 at the opposite lower right side concavely deforms.

Next, in (b), a voltage of +10V is applied to the upper right side individual electrode 56, a voltage of −10V is applied to the lower left side individual electrode 54, and voltage is not applied to the remaining individual electrodes 52, 58. Thus, at the vibrating plate 46, the lower left side region R2 demarcated by the diagonal line directed downwardly toward the right convexly deforms, and the opposite upper right side region R4 concavely deforms.

Then, in (c), a voltage of +10V is applied to the upper left side individual electrode 52, a voltage of −10V is applied to the lower right side individual electrode 58, and voltage is not applied to the remaining individual electrodes 54, 56. Thus, at the vibrating plate 46, the upper left side region R1 demarcated by the diagonal line directed upwardly to the right concavely deforms, and the opposite lower right side region R3 convexly deforms.

Next, in (d), a voltage of −10V is applied to the upper right side individual electrode 56, a voltage of +10V is applied to the lower left side individual electrode 54, and voltage is not applied to the remaining individual electrodes 52, 58. Thus, at the vibrating plate 46, the region R2 at the lower left side demarcated by the diagonal line directed downwardly to the right concavely deforms, and the opposite upper right side region R4 convexly deforms.

Then, due to a state arising in which a voltage of −10V is applied to the upper left side individual electrode 52, a voltage of +10V is applied to the lower right side individual electrode 58, and voltage is not applied to the remaining individual electrodes 54, 56, the state returns to the initial state shown in (a). Due to such concave and convex deformation continuously occurring repeatedly, a rotating traveling wave is generated within the pressure chamber 44.

Namely, due to a plurality of resonance modes, whose phases are offset 90° in time, being excited simultaneously at the vibrating plate 46, counterclockwise flexural deformation (convex and concave deformation) arises continuously at the vibrating plate 46 (see FIG. 10). As a result, compressive deformation of the pressure chamber 44 continuously arises in the counterclockwise direction. A counterclockwise rotational flow thereby arises in the ink within the pressure chamber 44.

Note that, in the same way as described above, it is also possible to generate a clockwise rotating traveling wave by making the phase offsets of the two voltage waveforms be opposite. Further, also in the embodiment shown in FIGS. 9A and 9B, the time required from the (a) state to the (a) state again, i.e., the period of the alternating current voltage (=the inverse of the resonance frequency of the resonance mode), is normalized and expressed as 1. Accordingly, the period thereof can be appropriately changed by setting the resonance frequency. Further, the value of the applied voltage being ±10V is an example, and the voltage which is applied is not limited to this value.

Provided that the phases of the sine waveforms (electric signals) of the applied alternating current voltages are offset 90° in time from one another, they may substantially coincide with the resonance frequencies corresponding to the resonance modes of the vibrating plate 46, or they may not coincide therewith. In either case, a plurality of resonance modes, which are orthogonal to one another spatially and whose phases are offset by 90° in time, can be excited simultaneously at the vibrating plate 46, and a rotating traveling wave which is counterclockwise or clockwise can thereby be generated.

In the same way as described above, a structure is utilized in which a counterclockwise (or clockwise) rotational flow is generated in the ink within the pressure chamber 44, and the ink is discharged from the nozzle 42. Thus, it suffices to provide one piezoelectric element 50 at each pressure chamber 44, and even a highly viscous ink can be suitably discharged from the nozzle 42 due to this single piezoelectric element 50.

Hereinafter, operation of the inkjet recording device 10 having the above-described structure will be explained.

First, when an electric signal of a print command is sent to the inkjet recording device 10, one of the recording sheets P is picked-up from the sheet feed tray 26, and is conveyed to a predetermined position by the subscanning mechanism 18. Then, while the recording heads 32 mounted to the carriage 12 move in the main scanning direction, ink drops are selectively discharged from the plural nozzles 42. In this way, a portion of the image based on the image data is recorded in a predetermined band region on the recording sheet P.

Specifically, at the inkjet recording unit 30, ink is injected (filled) from the ink tank 34 via the ink injection openings 36 into the pools 38 of the recording head 32. As shown by arrow F in FIGS. 3 and 5A, the ink which is filled in the pool 38 is supplied from the ink supply opening 48 to the pressure chamber 44, and is filled to the communicating path 43 which communicates with the nozzle 42. At this time, at the distal end (the discharge opening) of the nozzle 42, a mechanism which makes the surface of the ink sink-in slightly toward the pressure chamber 44 side is formed. Then, alternating current voltages such as described above are applied to the individual electrodes 52, 54 (56, 58) of the piezoelectric element 50, and a counterclockwise rotating traveling wave is generated at the vibrating plate 46 which structures the pressure chamber 44.

Namely, a counterclockwise rotational flow is generated in the ink within the pressure chamber 44 by the piezoelectric element 50. The ink within the communicating path 43 is pressurized by a predetermined pressure (maximum positive pressure) which arises due to the counterclockwise rotational flow, and thereafter, by stopping the rotational flow, the ink within the communicating path 43 separates, and is discharged from the nozzle 42 as an ink drop. At this time, the ink may be separated by, rather than stopping the rotational flow, generating a rotational flow which rotates reversely (clockwise in this case).

In any case, by carrying out such control, even a highly viscous ink is suitably discharged as an ink drop from the nozzle 42. Further, at the time when the ink drop is discharged, a counterclockwise rotational flow is generated in the ink within the pressure chamber 44, and therefore, the central portion of this rotational flow is negative pressure. Accordingly, as the ink drop is discharged, ink is sucked in from the ink supply opening 48 provided at the center of the pressure chamber 44. Thus, preparations are instantaneously made for the discharging of the next ink drop, and even a highly viscous ink is suitably made to flow into the pressure chamber 44.

When a portion of the image based on the image data has been recorded onto the recording sheet P in this way, the recording sheet P is conveyed a predetermined pitch by the subscanning mechanism 18. In the same way as described above, by selectively discharging ink drops from the plural nozzles 42 while moving the recording heads 32 in the main scanning direction, a portion of the image based on the image data is recorded in the next band region on the recording sheet P. This operation is carried out repeatedly, and when the image based on the image data has been completely recorded on the recording sheet P, the recording sheet P is conveyed to the end by the subscanning mechanism 18, and the recording sheet P is discharged onto the sheet discharge tray 28. In this way, printing processing (image recording) onto the recording sheet P is completed.

As described above, by simultaneously exciting, by a single actuator (the piezoelectric element 50) a plurality of resonance modes (natural vibration modes) whose phases are offset 90° in time, a pressure gradient can be generated in the ink within the pressure chamber 44, and a counterclockwise (or clockwise) rotational flow (rotating traveling wave) can be generated. Therefore, a flow of ink from the ink supply opening 48 (the ink flow-in opening) to the communicating path 43 (the ink flow-out opening) can be generated.

By providing the ink supply opening 48 at the position of the center of rotation which is negative pressure, the time required for refilling the ink from the pool 38 (the ink flow path) into the pressure chamber 44 can be shortened. Namely, because ink can be refilled simultaneously with the discharging of the ink drop, the next ink drop can be discharged in an instant. In this way, refilling of ink from the ink supply opening 48 can be carried out efficiently, and the printing speed can therefore be improved.

Because the nozzle 42 (the communicating path 43) is provided at the outermost peripheral side of the pressure chamber 44 (the portion where there is the maximum positive pressure), the discharge of ink from the nozzle 42 can be carried out efficiently. Accordingly, even if the ink is highly viscous, it can be suitably discharged as an ink drop. Further, by generating a rotating flow in one direction, air bubbles also can be discharged easily.

By appropriately setting the periods of the sine waveforms (the electric signals) of the alternating current voltages which are applied and adjusting the rotational speed of the rotating traveling wave, it is possible to control the amount of ink which is refilled from the ink supply opening 48 and the amount of ink which is discharged from the nozzle 42 (the volume of the ink drop discharged from the nozzle 42). Therefore, the printing efficiency can be improved. Note that the controlling of the amount of ink which is discharged from the nozzle 42 can also be carried out by offsetting the phases of the sine waveforms (electric signals) of the applied alternating current voltages by, for example, 90° in the opposite direction, so as to generate a rotating traveling wave which rotates in the opposite direction and adjust the pressure within the pressure chamber 44.

Because it suffices to provide one piezoelectric element 50 as an actuator for each of the pressure chambers 44, a large surface area is not required for placement of the piezoelectric elements 50. Accordingly, it is possible to reduce the surface area between the respective ejectors 40, and the nozzles 42 can be arranged at a high density. Further, it suffices to provide the same number of piezoelectric elements (actuators) 50 as the number of pressure chambers 44. Thus, the manufacturing cost for the placement thereof can be reduced. In addition, a simple profile (a sine waveform) suffices for the driving waveform (the electric signal) of the alternating current voltage which is applied, and therefore, the manufacturing cost of the driving system, such as electric circuits and the like, also can be reduced.

Note that persons skilled in the art will be able to conceive of various structures which can simultaneously excite a plurality of resonance modes whose phases are offset in time, in accordance with the present invention.

A structure in which a plurality of the individual electrodes 52, 54 (56, 58) are provided is preferable because the plural resonance modes, whose phases are offset in time, can be easily excited.

Providing fewer individual electrodes 52, 54 (56, 58) is preferable in that the wiring can be simplified. Namely, a structure in which only the individual electrodes 52, 54 are provided and alternating current voltages of driving waveforms (electric signals) which substantially coincide with the resonance frequencies corresponding to the resonance modes of the vibrating plate 46 are applied, is preferable because the manufacturing cost can be reduced as compared with a structure in which the individual electrodes 52, 54, 56, 58 are provided. Moreover, the actuator is not limited to the piezoelectric element 50, and may be, for example, an actuator utilizing electrostatic force or magnetic force.

In the inkjet recording device 10 of the above-described embodiment, the inkjet recording units 30 of the respective colors of black, yellow, magenta, and cyan are mounted to the carriage 12, and the ink drops are selectively discharged from the recording heads 32 of the respective colors on the basis of the image data, and a full-color image is recorded on the recording sheet P. However, the inkjet recording in the present invention is not limited to the recording of characters and images onto the recording sheet P.

Namely, the recording medium is not limited to paper, and the liquid which is discharged is not limited to ink. The recording head 32 relating to the present invention can be applied to liquid drop jetting devices on the whole which are used industrially, such as, for example, in the fabrication of color filters for displays by discharging ink out onto a macromolecular film or glass, the formation of bumps for parts packaging by discharging solder in a molten state onto a substrate, and the like.

As described above, in accordance with the present invention, there is provided a recording head which can shorten the time for refilling ink into a pressure chamber which communicates with a nozzle, and in which nozzles can be disposed at a high density and the manufacturing cost can be reduced.

What is claimed is:

1. An inkjet recording head comprising:

an ink flow path; and a plurality of ejectors which are connected to the ink flow path, each ejector including a pressure chamber, a nozzle, and a single actuator which includes a plurality of individual electrodes and a deformable internal space of the pressure chamber in order to discharge ink, wherein each individual electrode has a surface area of approximately one-fourth the surface area of the actuator and is provided in one of an upper left side, lower left side, upper right side, and lower right side of the actuator, wherein alternating current voltages, whose phases differ in time, are applied respectively to the individual electrodes such that the actuator is driven and controlled so as to simultaneously vibrate a plurality of resonance modes with phases thereof offset in time and an ink rotational flow is generated within the pressure chamber due to the simultaneous vibration, and wherein a speed of the ink rotational flow is controlled by setting the periods of electric signals of the alternating current voltages.

2. The inkjet recording head of claim 1, wherein resonance frequencies of the plurality of resonance modes substantially coincide.

3. The inkjet recording head of claim 1, wherein the pressure chamber has an ink flow-in opening which is provided at a place corresponding to a negative pressure portion of the ink rotational flow and which is connected to the ink flow path.

4. The inkjet recording head of claim 1, wherein the pressure chamber has an ink flow-out opening which is provided at a place corresponding to a positive pressure portion of the ink rotational flow and which is connected to the nozzle.

5. The inkjet recording head of claim 1, wherein the ejectors are disposed at predetermined intervals along the ink flow path.

6. The inkjet recording head of claim 1, wherein the plurality of individual electrodes is disposed on the actuator in a plane defined by the actuator.

7. An inkjet recording device jetting ink drops onto a medium, the device comprising:

(A) a plurality of inkjet units, each inkjet unit having a head, the head including:

(i) an ink flow path; and (ii) a plurality of ejectors which are connected to the ink flow path, each ejector including a pressure chamber, a nozzle, and a single actuator which includes a plurality of individual electrodes and a deformable internal space of the pressure chamber in order to discharge ink, (iii) wherein each individual electrode has a surface area of approximately one-fourth the surface area of the actuator and is provided in one of an upper left side, lower left side, upper right side, and lower right side of the actuator, (iv) wherein alternating current voltages, whose phases differ in time, are applied respectively to the individual electrodes such that the actuator is driven and controlled so as to simultaneously vibrate a plurality of resonance modes with phases thereof offset in time and an ink rotational flow is generated within the pressure chamber due to the simultaneous vibration, and (v) wherein a speed of the ink rotational flow is controlled by setting the periods of electric signals of the alternating current voltages;

(B) a holding section integrally accommodating the inkjet units; and (C) a mechanism for moving and driving at least one of the medium and the holding section at a time of jetting ink drops.

8. The inkjet recording device of claim 7, wherein resonance frequencies of the plurality of resonance modes substantially coincide.

9. The inkjet recording device of claim 7, wherein the pressure chamber has an ink flow-in opening which is provided at a place corresponding to a negative pressure portion of the ink rotational flow and which is connected to the ink flow path.

10. The inkjet recording device of claim 7, wherein the pressure chamber has an ink flow-out opening which is provided at a place corresponding to a positive pressure portion of the ink rotational flow and which is connected to the nozzle.

11. The inkjet recording device of claim 7, wherein the ejectors are disposed at predetermined intervals along the ink flow path.

12. The inkjet recording device of claim 7, wherein the plurality of individual electrodes is disposed on the actuator in a plane defined by the actuator.

13. An inkjet recording head comprising:

an ink flow path; and a plurality of ejectors which are connected to the ink flow path, each ejector including a pressure chamber, a nozzle, and a single actuator which includes a plurality of individual electrodes and a deformable internal space of the pressure chamber in order to discharge ink, wherein each individual electrode has a surface area of approximately one-fourth the surface area of the actuator and is provided in one of an upper left side, lower left side, upper right side, and lower right side of an actuator, and wherein alternating current voltages, whose phases differ in time, are applied respectively to the individual electrodes such that the actuator is driven and controlled so as to simultaneously vibrate a plurality of resonance modes with phases thereof offset in time and an ink rotational flow is generated within the pressure chamber due to the simultaneous vibration.

14. The inkjet recording head of claim 13, wherein a speed of the ink rotational flow is controlled by setting the periods of electric signals of the alternating current voltages.

15. The inkjet recording head of claim 13, further comprising a vibrating plate adhered to the actuator, wherein the plurality of individual electrodes is provided in a plane, the individual electrodes causing convex and concave deformations of the vibrating plate.

16. An inkjet recording device jetting ink drops onto a medium, the device comprising:

(A) a plurality of inkjet units, each inkjet unit having a head, the head including:

(i) an ink flow path; and (ii) a plurality of ejectors which are connected to the ink flow path, each ejector including a pressure chamber, a nozzle, and a single actuator which includes a plurality of individual electrodes and a deformable internal space of the pressure chamber in order to discharge ink, (iii) wherein each individual electrode has a surface area of approximately one-fourth the surface area of the actuator and is provided in one of an upper left side, lower left side, upper right side, and lower right side of an actuator, and (iv) wherein alternating current voltages, whose phases differ in time, are applied respectively to the individual electrodes such that the actuator is driven and controlled so as to simultaneously vibrate a plurality of resonance modes with phases thereof offset in time and an ink rotational flow is generated within the pressure chamber due to the simultaneous vibration;

(B) a holding section integrally accommodating the inkjet units; and (C) a mechanism for moving and driving at least one of the medium and the holding section at a time of jetting ink drops.

17. The inkjet recording device of claim 16, wherein a speed of the ink rotational flow is controlled by setting the periods of electric signals of the alternating current voltages.

18. The inkjet recording device of claim 16, further comprising a vibrating plate adhered to the actuator, wherein the plurality of individual electrodes is provided in a plane, the individual electrodes causing convex and concave deformations of the vibrating plate.

* * * * *